United States Patent [19]

Biddle

[11] 4,012,105

[45] Mar. 15, 1977

[54] COAXIAL ELECTRICAL CONNECTOR

[75] Inventor: Christopher Scott Biddle, Issaquah, Wash.

[73] Assignee: Bell Industries, Inc., Los Angeles, Calif.

[22] Filed: Sept. 30, 1974

[21] Appl. No.: 510,434

[52] U.S. Cl. ..... 339/177 R; 339/183; 339/258 P

[51] Int. Cl.[2] ..... H01R 17/18

[58] Field of Search ..... 339/14 R, 14 P, 177 R, 339/177 E, 182 R, 183, 252 P, 258 R, 258 P

[56] References Cited

UNITED STATES PATENTS

| | | | |
|---|---|---|---|
| 431,412 | 7/1890 | Studte | 339/177 R |
| 1,169,099 | 1/1916 | Wilcox | 339/183 |
| 2,085,486 | 6/1937 | Jillani | 24/216 |
| 2,221,280 | 11/1940 | Woodside | 339/258 R |
| 2,615,951 | 10/1952 | Klostermann | 339/258 R |
| 3,158,964 | 12/1964 | Haas | 24/216 |
| 3,275,970 | 9/1966 | Johanson | 339/177 R |
| 3,340,495 | 9/1967 | Weinschel | 339/177 R |
| 3,601,776 | 8/1971 | Curl | 339/177 R |

*Primary Examiner*—Roy Lake
*Assistant Examiner*—Mark S. Bicks
*Attorney, Agent, or Firm*—Lindenberg, Freilich, Wasserman, Rosen & Fernandez

[57] ABSTRACT

A coaxial connector in which the receptacle includes an outer shell that contains a sliding ring-shaped contact which is urged forwardly by a coil spring, the coil spring having a few turns at its rearward end which are firmly captured so that a low resistance connection is established through the spring. The receptacle also includes an inner tubular contact which is tapered to a minimum diameter at a throat region and which has slots forming resilient contact fingers, for receiving a tapered or straight pin-shaped plug member. In the case of a tapered pin-shaped plug member, the radius of curvature of the tubular inner contact at the throat thereof is precisely equal to the diameter of the pin-shaped member at the locations where they are engaged when the plug is fully inserted into the receptacle.

9 Claims, 7 Drawing Figures

Fig. 1
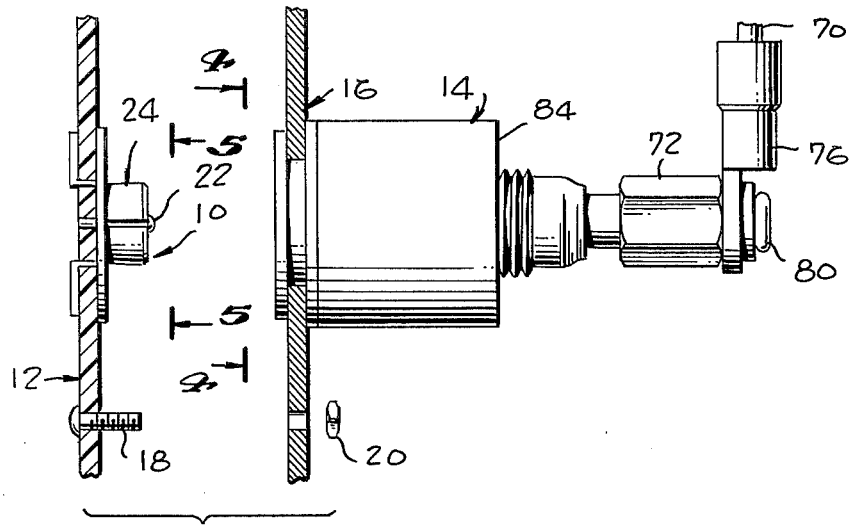
Fig. 4
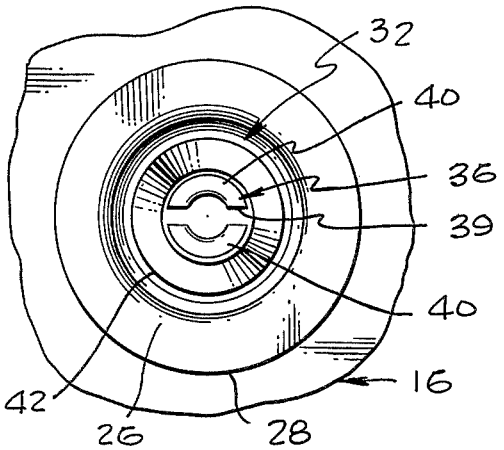
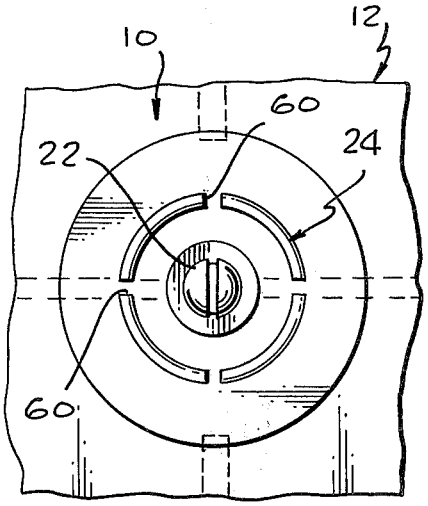
Fig. 5
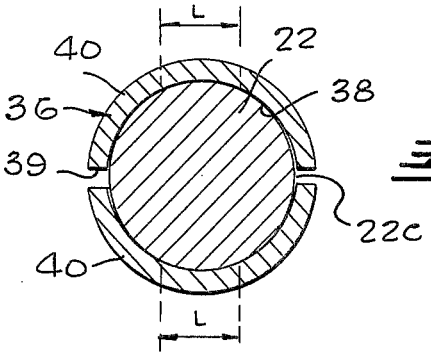
Fig. 6

COAXIAL ELECTRICAL CONNECTOR

BACKGROUND OF THE INVENTION

This invention relates to electrical connectors.

One type of common electrical connector is a coaxial type in which the plug includes a central pin contact with a tube or barrel contact around the pin, and the receptacle includes a pair of coaxial tubes for receiving the plug contacts. Edge lighted panels of the type utilized in aircraft cockpit displays typically use this type of connector to transmit power between the display panel and the aircraft electrical system. Problems are often encountered in mating and unmating the connectors. During mating, the installer holding the panel cannot see the receptacle on the airplane and tries to find its location by feel. Often, when the installer positions the panel to mate the connectors, the center pin of the plug does not enter the inner receptacle tube but instead lodge in the space between the outer tube and the tubular insulator surrounding the inner tube. When the installer feels this false lodging he pushes on the panel, intending to engage the plug and receptacle, but actually causing damage to them.

During unmating, or extraction of a panel, damage can occur if the plug is not pulled "on axis" but is instead tilted. At present, repairmen devise special tools to pry off the panels without excessive tilting, but this results in considerable wasted time and occasional damage.

The possibility of damage can be minimized if the connectors are designed for low-force insertion and separation. However, a connector, such as a receptacle, designed for low force insertion and extraction may find limited use because the plugs with which it must mate may vary in size where they are made by different companies, even though the plugs may all be of the same nominal size. A receptacle which could accommodate plugs which all had the same nominal size designation but which actually varied over an appreciable range, and which assured good contact with such plugs while also assuring low force insertion and extraction of the plugs, would be very valuable.

SUMMARY OF THE INVENTION

In accordance with one embodiment of the present invention, a coaxial connector assembly is provided which minimizes the engagement and separation forces of the connectors and which enables a receptacle to make good contact with plugs of the same nominal size but of a range of actual sizes. The receptacle includes a pair of shells forming an annular region for receiving the outer coaxial conductor of a plug, and also includes a ring-shaped contact lying in the annular region and forwardly biased by a coil spring. The coil spring has a few turns at its rearward end which are firmly captured between the shells so that current can be readily transmitted through the coil spring to the ring-shaped contact.

The receptacle also includes a tubular inner contact with slots that form it into at least two resilient fingers. The fingers are angled towards one another and form a throat region of smallest diameter near the forward or open end of the receptacle for receiving a tapered or straight pin-shaped plug element. The radius of curvature of the fingers at the throat thereof is precisely equal to the radius of curvature of the pin at the location where they remain in contact after the plug has been fully inserted into the receptacle. By utilizing the same diameter, a substantially line contact is established between the pin and fingers instead of a point contact.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of a receptacle and plug of the invention, the plug being mounted on a circuit board and the receptacle being mounted to an aircraft structure;

FIG. 4 is a view taken on the line 4—4 of FIG. 1;

FIG. 5 is a view taken on the line 5—5 of FIG. 1;

FIG. 6 is a view taken on the line 6—6 of FIG. 2; and

DESCRIPTION OF THE PREFERRED EMBODIMENTS

Figures 2, 3:
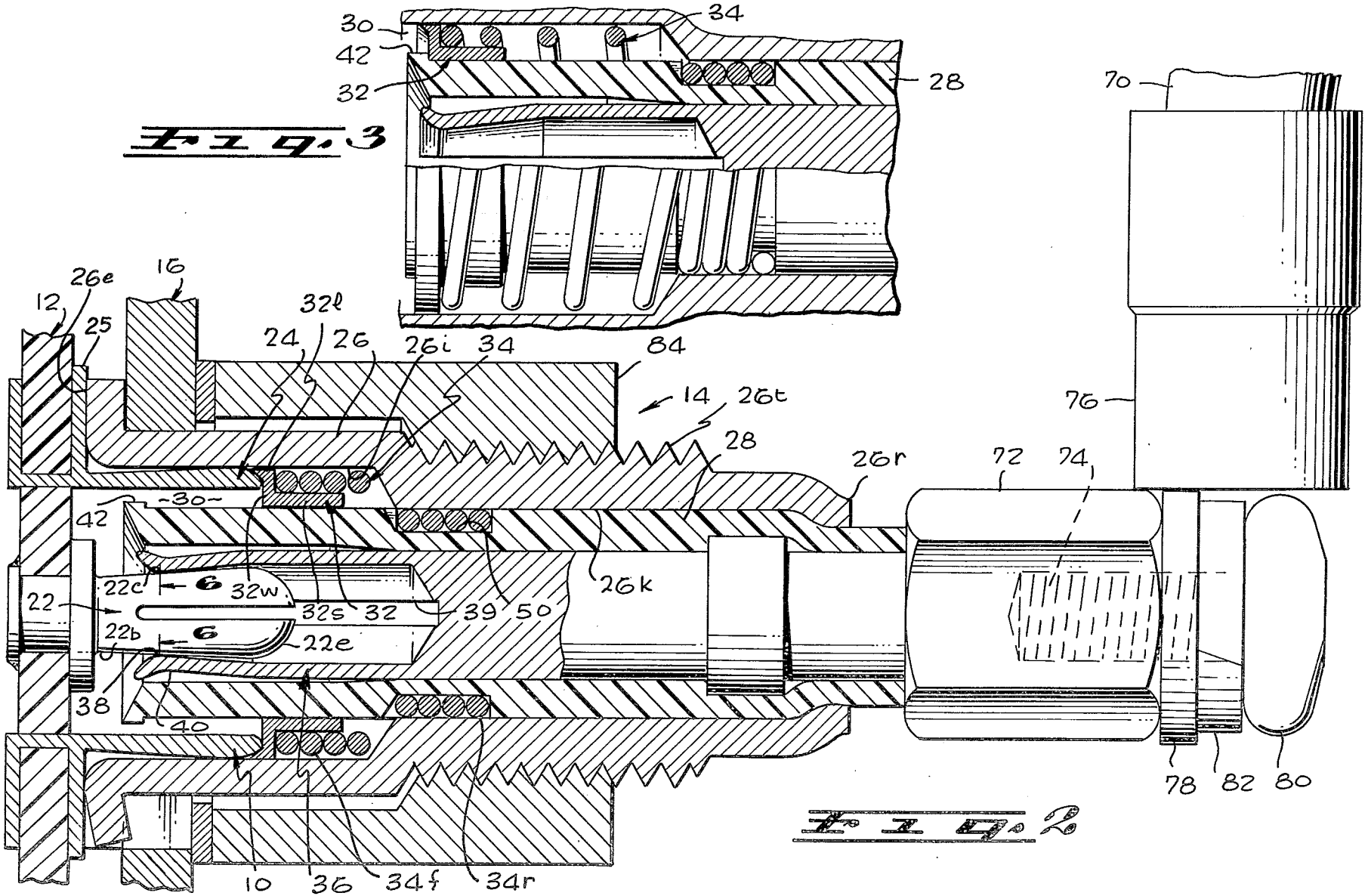
FIG. 2 is a sectional side view of the connector of FIG. 1, shown in a mated configuration.
FIG. 3 is a partial sectional side view of the receptacle of FIG. 2 in an unmated configuration.

FIG. 1 illustrates a coaxial connector which includes a plug 10 mounted on a circuit board 12 which is attached to an edge-lighted panel (not shown), and a receptacle 14 mounted on an aircraft structure 16. The circuit board 12 may be brought against the aircraft structure 14 to mate the plug with the receptacle, and the board may be held to the aircraft structure by a group of screw and nut fasteners 18, 20 or the like. As also shown in FIG. 2, the plug includes a central pin-shaped plug element or pin 22 and a tubular outer plug element or barrel 24. The receptacle 14 is designed to receive and make good electrical contact with both of these plug elements. The receptacle includes an outer shell 26 with an open forward end that faces the plug, and also includes an inner shell 28 disposed concentrically within the outer shell. The inner shell 28 is of considerably smaller diameter than the inside wall **26*i* of the outer shell, to leave a thick annular region 30 between them. A ring-shaped or annular contact 32 is loosely held in the annular region 30, so that the annular contact 32 can easily slide forward and rearwardly in this region. A coil spring 34 has a forward portion also disposed in the annular region 30 behind the contact 32, to bias the contact 32 in a forward direction towards the mating plug 10. The receptacle also includes an inner conductor 36 with a tubular forward end which is tapered to have a minimum diameter at a throat region 38 near its forward end. The inner conductor 36 also has a pair of slots 39 that divide it into a pair of fingers 40 that can resiliently grasp the pin 22** of the plug.

The receptacle assumes the configuration of FIG. 3 prior to the insertion of the plug therein. In this configuration, the coil spring 34 urges the ring-shaped outer receptacle contact 32 forwardly until it abuts a ledge portion 42 formed on the sleeve 28. When the barrel 24 of the plug is inserted into the annular region 30, it presses the contact 32 rearwardly against the biasing of the spring 34. Thus, when the plug has been fully inserted, the contact 32 presses with a substantial force against the end of the barrel 24 to establish a low resistance contact therewith. The spring 34 constantly urges the receptacle contact and barrel 32, 24 into engagement in spite of any vibrations that may occur which could slightly move the receptacle away from the plug.

Current from the outer receptacle contact 32 is carried through the forward turns 34*f* of the spring to rearward turns 34*r* of the spring which make firm contact with the outer shell 26. The spring has three and one-half rearward turns 34*r* of a smaller diameter than the forward turns 34*f*, and with the rearward turns 34*r* held in a groove 50 formed in the inner shell 28. However, the internal diameter at 26*k* of the capturing shell portion lying about the rearward spring turns 34*r* is less than the free, or unrestrained, outer diameter of these spring turns, so that the rearward spring turns 34*r* are firmly captured and compressed by the outer shell to establish good electrical contact therewith. Thus, the rearward end of the spring is firmly held and electrically contacted without requiring sharp bending thereof. The spring 34 is constructed of a resilient material of high conductivity such as beryllium copper, and is formed with the rearward turns 34*r* swedged to a smaller diameter than the forward turns, which permits the construction of a receptacle of small overall diameter.

The receptacle is designed to mate with plugs having barrels such as 24 of varying diameter. Plugs on many previously installed edged panel displays of aircraft have outer diameters which are nominally ¼ inch. However, the actual outer barrel diameters for the quarter-inch plugs of different manufacturers vary, usually in a range from 0.245 inch to 0.255 inch. The barrels 24 usually have four slots to form four resilient fingers that can be flexed slightly to establish a good wiping contact with a receptacle wall of proper inside diameter. However, if the receptacle inside diameter is slightly too small, then the barrel will not enter without excessive insertion forces that lead to damage, and if the receptacle is slightly too large then reliable contact will not be established with the barrel. By utilizing the longitudinally biased receptacle contact 32 in the present receptacle, good contact can be established even if a barrel similar to barrel 24 but of slightly smaller diameter, cannot make good contact with the inside shell wall 26*i*. The inside diameter of the outer shell at 26*i* is chosen to receive the largest commonly available plug of nominally one-quarter inch diameter, such as 0.255 inch. The barrel of such a plug makes contact directly with the shell inner wall 26*i* as well as with the sliding ring contact 32. If slightly smaller plugs are received, they will not establish reliable contact with the shell wall 26*i*, but will establish good contact with the outer receptacle contact 32. The particular barrel 24 of this invention is tapered in outside diameter to prevent damage if there is tilting at the beginning of unmating, and has a maximum diameter near its outer end which allows wiping contact with the outer shell 26. The outer receptacle contact 32 has a forward washer portion 32*w* with a forwardly-extending lip 32*l* at its rim and with a rearwardly extending sleeve portion 32*s* at its hub lies within the spring and which assures smooth sliding along the inner shell 28.

The inner receptacle contact 36 makes wiping contact with the plug pin 22. Although the diameter of a plug pin 22 for a nominal quarter inch connector may vary for those of different manufacturers, the variation is usually small. Thus, solid pins normally have a constant outer diameter of between 0.081 to 0.083 inch, while slotted pins usually have a constant outer diameter of between 0.081 inch and 0.085 inch. Of course, the slotted pins readily deflect to a slightly smaller diameter. This relatively small range of sizes permits the inner receptacle contact 36 to receive and make good contact with any of the pins.

Although the receptacle 14 is designed to receive and make good contact with plugs which vary in barrel and pin diameter, the receptacle is also designed to make especially good contact with the particular plug 10 which is designed specifically for the receptacle 14. The barrel 24 has several slots 60 (FIG. 5) which form it into several resilient fingers, and the outer diameter of the barrel 24 is slightly larger than the diameter of the inside shell surface 26*i* to establish sliding contact with the receptacle inner contact 36 at the throat thereof. The center pin 22 is tapered in diameter along its length with a maximum diameter near its free end 26*e*, but has a carefully chosen diameter at the location 22*c*, where it contacts the throat 38 of the receptacle inner contact after full insertion. The location 22*c* is on the fixed end portion of the pin which is opposite the free end 26*e*. The receptacle inner conductor 36 has a radius of curvature at its throat 38 which is precisely equal to the outer diameter 22*c* of the corresponding pin location. The outer end 26*e* of the outer shell, which abuts a fixed barrel portion 25 lying on the circuit board, forms a means for limiting the insertion depth of the plug to a depth at which the pin location 22*c* engages the throat location 38 of the receptacle conductor 36. As shown in FIG. 6, the substantially equal radiuses of curvature can provide for contact between the pin and inner receptacle contact along a high proportion of the pin periphery. In actuality, a long line of contact cannot be achieved without large forces to deflect the contacts against one another, but a greater line or area of contact is achieved by making the radiuses of curvature of the pin and receptacle throat 38 nearly equal. The radiuses of curvature at the throat 38 and at the pin location 22*c* can be readily maintained within 1,000th inch of one another for the above-described pin diameter of about 0.081, or in other words within about one percent of the pin diameter, to maximize the contact area. The actual contact area may be approximated by a pair of rectangles each of a length L extending along the circumference of the pin 22 and with a narrow width extending in a direction along the length of the pin.

The tapered pin 22 of the plug is designed to facilitate extraction when mated to a receptacle designed to receive an untapered pin. In such a receptacle, contact with the pin 22 is established at its location of greatest diameter near its free end 22*e*. The pin 22 can wobble during initial extraction without damaging the receptacle, because of the small diameter at its base 22*b*. The barrel 24 is tapered for a similar reason.

When the plug is mated to the receptacle, a substantial force such as 2 to 4 pounds may be required to cause the pin 22 to spread apart the resilient fingers 40 of the inner receptacle contact and to allow the outer plug member 24 to overcome the force of the spring 34. Such insertion force is usually easily applied by merely pressing against the circuit board 16 on which the receptacle is mounted to press it towards the other circuit board 12 on which the plug is mounted. Then, fasteners such as the screw 18 and nut 20 may be installed to securely hold the circuit boards together and therefore hold the plug in the receptacle. When the plug and receptacle must be disconnected, damage to one of them is more likely to occur if a large extraction force is required. This is because extraction may have to occur by pulling out the relatively thin circuit board 16 away from the other board 12. However, extraction force is minimized by reason of the fact that the spring 34 tends to separate the plug from the receptacle. In fact, initial separation is often encouraged because initially the spring 34 is in a highly compressed configuration. The force of the spring 34 tends to overcome some or all of the retaining force of the resilient fingers 40 against the plug pin 22. The actual extraction force in the above-described connector can be readily held to less than one pound and may range to zero.

The particular receptacle 14 is designed to enable firm connection to the aircraft structure 16 and to enable the connection of a wire 70 to the inner receptacle contact 36. The inner receptacle contact 36 is constructed of a rod of resilient and highly conductive material such as beryllium copper, and has a rearward end formed into a nut 72 with an internal thread 74. The wire 70 can be connected to the inner receptacle contact through a coupling 76 which has a flange 78 held to the contact by a screw 80 and lock washer 82. The inner shell 28 which surrounds the inner receptacle contact is constructed of an insulative material such as nylon. The outer shell 26 has a rearward end **26*r* which is swedged around the inner shell 28 to deform them close around the inner contact 36. The outer shell 26 has threads 26*t* along its rearward portion which receive a nut 84 that can hold the receptacle firmly against the aircraft structure 16.**

The receptacle 14 is designed to minimize the possibility of damage during insertion, when an installer holding the panel on which the circuit board 12 is mounted cannot see the receptacle. When there is proper alignment and the installer presses with a small force, he causes the pin 22 to enter the inner conductor 36 by spreading apart the fingers 40 thereof, which provides a spring action feel to the installer to indicate proper alignment. If the pin 22 is lodged between the outer shell 26 and insulator or inner shell 28, there will be a hard resistance rather than a spring-like yielding, and the installer will feel this before he has pressed hard enough to do damage. The receptacle also minimizes the possibility of damage during unmating even if the plug is oriented "off-axis", or in other words with its axis angled from that of the receptacle. Such damage from an off-axis orientation is prevented because the resilient fingers 40 of the receptacle inner conductor 26 can deflect under a sidewardly tilting pin even if the pin is not tapered. In a situation where the tapered pin 22 of the plug is being extracted from an inner conductor similar to 36 but which is straight (cylindrical) and without slots that form resilient fingers, damage due to tilting by several degrees is avoided because of the tapering of the pin 22. The tapering of the barrel 24 also helps avoid damage due to tilting, if the tilting occurs at the beginning of extraction when the outer shell 26 would otherwise bear against the bottom or inner end of the barrel which is a location where the barrel cannot readily deflect despite the slots 60 therein.

Figure 7:
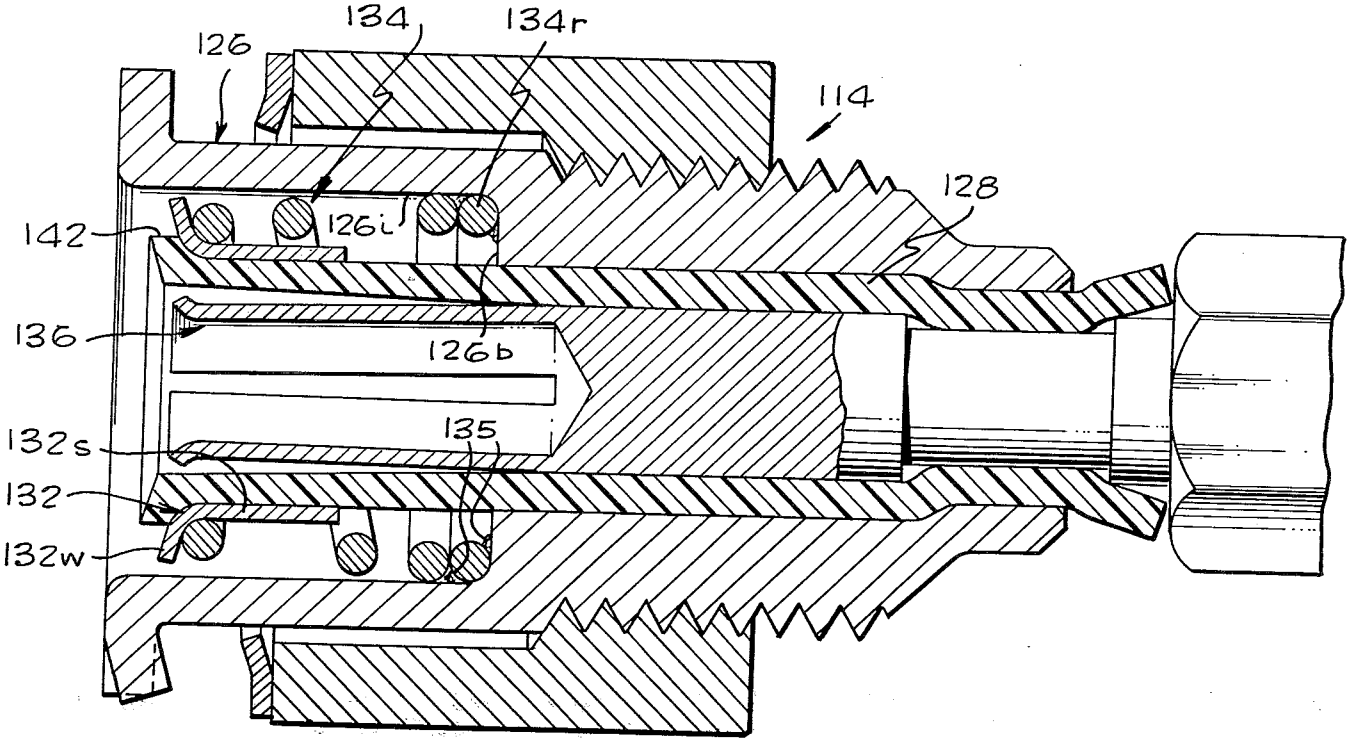
FIG. 7 is a sectional view of a connector receptacle constructed in accordance with another embodiment of the invention.

The receptacle can be constructed in a variety of ways. FIG. 7 illustrates another receptacle 114 in which the spring 134 is tapered or conical, and has a pair of rearward turns **134*r* which are fixed in place and in electrical contact to the outer shell 126 by forming the rearward spring turns 134*r* to a larger unrestrained outer diameter than the inside 126*i* of the shell. Thus, when the spring 126 has been inserted into the shell until it abuts a bottom wall or ledge 126*b* of the shell, the rearward turns 134*4* form an interference fit with the shell to provide good electrical contact therewith. Additional reliability of the connection is assured by joining the rearward spring turn to the inner wall of the shell by welding or soldering, as at the solder joint 135. The inner contact 136, inner shell or sleeve 128, with a ledge 142, contact 132, and the rest of the receptacle 114 are otherwise largely similar to the receptacle 14 of FIG. 2.**

Thus, the invention provides a miniature coaxial connector which facilitates connection and disconnection of the plug from the receptacle, which enables the receptacle to receive and make good contact with plugs of a range of sizes, and which enables especially good contact to be made with a pin of a plug of particular size. This is accomplished by utilizing a receptacle with a wide barrel-receiving region which contains a slideable ring contact urged forwardly by a coil spring, the coil spring providing pressure to establish good contact with the tip of a barrel over a range of sizes thereof and also helping to separate the plug from the receptacle to assure low extraction forces. An especially good contact with the pin of the plug is made by utilizing an inner receptacle contact with a throat area having the same radius of curvature as the pin location which it contacts after full insertion of the plug into the receptacle. The inner receptacle contact has slots that form resilient fingers, while the plug has a central pin which is tapered.

Although particular embodiments of the invention have been described and illustrate herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. An electrical connector for receiving and making electrical contact with a plug, comprising:

an outer shell with an open forward end;

a ring-shaped contact disposed in said outer shell; and a coil spring having a forward spring portion movably disposed in said outer shell and bearing against said ring-shaped contact to urge said contact towards said open forward end of said shell;

said coil spring having a rearward end portion; and including means firmly pressing radially against said rearward end portion of said coil spring for fixedly holding said rearward end portion and making low resistance contact therewith.

2. The electrical connector described in claim 1 wherein:

said outer shell has a portion which forms said means disposed about said rearward turn of said spring; and said coil spring has a rearward turn of larger diameter than its forward turn, the outer diameter of said rearward turn when unrestrained being greater than the inside diameter of said outer shell portion which surrounds said rearward turn, whereby to form an interference fit between the shell and rearward spring turn.

3. The electrical connector described in claim 1 including:

an inner shell disposed within said outer shell and having a groove therein; and wherein said rearward portion of said coil is formed to a reduced outer diameter smaller than the diameter of the forward portion of the coil spring and lies in said groove of said inner shell; and said means for holding and making contact with said spring includes a capturing portion formed on said outer shell, said capturing portion having a reduced inner diameter smaller than the free diameter of said rearward turn of said coil and surrounding and pressing radially inwardly on said rearward turn of said coil.

4. An electrical connector for receiving and making electrical contact with a substantially tubular barrel, comprising:

an outer shell (126) with an open front end;

a sleeve (128) lying within said outer shell, to leave an annular space between them, said sleeve having an outwardly extending ledge (142) at its forward end;

a ring shaped contact (132) lying in the space between said outer shell and sleeve, said contact having a washer-like front portion (132*w*) which can abut said ledge on said sleeve, and a sleeve-like portion (132*s*) extending rearwardly from the hub of said washer portion; and a spring (134) having a forward portion lying about said sleeve-like portion of said contact and against said washer-like portion;

said outer shell having a ledge (126*b*) spaced rearwardly from its open front end; and said spring having a rearward portion (134*r*) which lies against said ledge and which has a larger unrestrained outer diameter than the inside of said outer shell to press outwardly thereagainst.

5. An electrical connector for receiving and making electrical contact with a plug comprising:

a shell with an open forward end;

a ring-shaped contact disposed in said shell; and a coil spring having a forward spring portion movably disposed in said shell and bearing against said ring-shaped contact to urge said contact towards said open forward end of said shell, said spring having a rearward spring portion;

the outer diameter of said rearward spring portion when unrestrained being greater than the inside diameter of said shell portion which surrounds said rearward spring portion, whereby to form an interference fit between the shell and rearward spring turn.

6. An electrical connector for receiving and making electrical contact with a plug, comprising:

an outer shell with an open front end;

a sleeve lying within said outer shell, to leave an annular space between them;

a ring shaped contact lying in the space between said outer shell and sleeve, said contact having a washer-like front portion and a sleeve-like portion extending rearwardly from the hub of said washer portion; and a spring having a forward portion lying about said sleeve-like portion of said contact and against said washer-like portion.

7. Electrical connector apparatus comprising:

a plug having an electrically conductive central pin and an electrically conductive barrel surrounding said pin, said pin and barrel each having a fixed end portion and an opposite free end;

a receptacle disposed around said plug, said receptacle having an outer shell closely receiving said barrel, and a tubular inner conductor closely receiving said pin;

both said pin and said barrel being tapered in outside diameter along a majority of the portions thereof which lie within said outer shell and inner conductor, respectively, said tapering being in a direction wherein portions of said pin and barrel progressively further from said fixed end portions thereof are of progressively greater diameter, whereby to prevent damage if the plug is tilted during initial extraction from a receptacle which closely surrounds the fixed end portions of the pin and barrel.

8. A coaxial electrical connector comprising:

an electrically conductive pin contact with a fixed inner end and a free outer end, said pin contact being smoothly tapered in diameter along most of its length in a direction wherein portions of the pin contact which are progressively closer to said free outer end are of progressively greater diameter;

a barrel contact; and means for holding said barrel contact so it extends about said pin contact and is electrically insulated therefrom.

9. The connector described in claim 8 including:

a receptacle including an outer shell for receiving and contacting said barrel contact and a tapered inner receptacle contact for receiving said pin contact;

said tapered inner receptacle contact being in the form of a tube with a free end and with slots in said free end that form said tube into resilient fingers, and being tapered on its inside so that it is of progressively smaller diameter at locations progressively closer to its free end.

* * * * *